US010016109B1

(12) United States Patent
Eldred

(10) Patent No.: US 10,016,109 B1
(45) Date of Patent: Jul. 10, 2018

(54) VACUUM ATTACHMENT

(71) Applicant: Ken Eldred, New Canaan, CT (US)

(72) Inventor: Ken Eldred, New Canaan, CT (US)

( * ) Notice: Subject to any disclaimer, the term of this patent is extended or adjusted under 35 U.S.C. 154(b) by 0 days.

(21) Appl. No.: 15/350,096

(22) Filed: Nov. 13, 2016

Related U.S. Application Data

(60) Provisional application No. 62/274,535, filed on Jan. 4, 2016.

(51) Int. Cl.
*A47L 9/06* (2006.01)
*A47L 5/24* (2006.01)
*A47L 13/38* (2006.01)

(52) U.S. Cl.
CPC ..... *A47L 9/0693* (2013.01); *A47L 5/24* (2013.01); *A47L 13/38* (2013.01)

(58) Field of Classification Search
CPC ..... A47L 9/0693; A47L 5/24; A47L 13/38; A47L 9/06; A47L 9/0613
See application file for complete search history.

(56) References Cited

U.S. PATENT DOCUMENTS 1,902,534 A * 3/1933 Wielatz ..... A47L 9/06 15/395
2,206,738 A * 7/1940 Brock ..... A47L 9/06 15/176.1
3,095,593 A * 7/1963 Krasne ..... A47L 13/38 15/184
4,972,541 A * 11/1990 Smith, Jr. ..... A47L 5/24 15/105
5,123,142 A * 6/1992 Miller ..... A47L 9/0613 15/234
6,370,731 B1 * 4/2002 Carter ..... A47L 9/06 15/393
7,784,149 B2 * 8/2010 Schwarz ..... A47L 5/24 15/209.1
2009/0172912 A1 * 7/2009 Knopow ..... A46B 15/0002 15/344

* cited by examiner

*Primary Examiner* — Dung Van Nguyen
(74) *Attorney, Agent, or Firm* — RG Patent Consulting, LLC; Rachel Gilboy

(57) ABSTRACT

An improved vacuum attachment is a vacuum attachment with feathers featuring perforated vacuum tubing for its shaft, from the bottom of the attachment to the top of the feather, which provides evenly channeled suction power and thus more-gentle when vacuuming the feather agitated dust particles on delicate items.

12 Claims, 4 Drawing Sheets

VACUUM ATTACHMENT

CROSS-REFERENCE TO RELATED APPLICATION

The present application is related to and claims priority from prior provisional application Ser. No. 62/274,535, filed Jan. 4, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of vacuum attachments and more specifically relates to an attachment for a vacuum cleaner which combines a vacuum nozzle and a feather duster, enabling consumers to gently and effectively dust and vacuum delicate, fragile objects without disturbing them.

2. Description of the Related Art

Whether you own a house in the suburbs or rent a studio apartment in the city, when you have your own living space, maintaining a household is a never ending job. Floors must be swept, carpets and rugs vacuumed, windows washed. Bedroom linens, bathroom towels and clothes have to be washed and dried and folded and put away; kitchen floors have to be mopped and sometimes waxed; dishes washed and dried; sinks scoured. To live well, we must keep our living space clean and in order. And one aspect of this regular maintenance—encountered in millions of consumer households across the country poses a particular problem.

The problem is that many of a home's furnishings—loose, often fragile or delicate objects on tabletops, counters, mantels, desks, bookshelves cannot be cleaned with a vacuum cleaner, but instead require dusting. Unfortunately, in the process of dusting such objects and surfaces, the dust raised by the feather duster becomes suspended in the air, only to settle again throughout the dwelling.

Various attempts have been made to solve the above-mentioned problems such as those found in U.S. Pat. No. 2,214,989 to Herbert D. Brand; U.S. Pat. No. 6,802,104 to Katherine B. Redd; and U.S. Pat. No. 1,040,176 to Charles L. Eichele. This art is representative of vacuum cleaner attachments with feathers. None of the above inventions and patents, taken either singly or in combination, is seen to describe the invention as claimed.

Ideally, a vacuum cleaner attachment should provide ease of installation, work effectively, and yet would operate reliably and be manufactured at a modest expense. Thus, a need exists for a reliable improved vacuum attachment to avoid the above-mentioned problems.

BRIEF SUMMARY OF THE INVENTION

In view of the foregoing disadvantages inherent in the known vacuum cleaner attachment art, the present invention provides a novel improved vacuum attachment. The general purpose of the present invention, which will be described subsequently in greater detail is to provide an attachment for a vacuum cleaner which combines a vacuum nozzle and a feather duster, enabling consumers to gently and effectively dust and vacuum delicate, fragile objects without disturbing them. With each feather featuring perforated vacuum tubing for its shaft, from the bottom of the attachment to the top of the feather, the suction power is evenly channeled and thus more-gentle when vacuuming the feather agitated dust particles on these delicate items.

An improved vacuum attachment comprising a plurality of feathers, each including an elongated hollow shaft having a quill portion at a proximal end, and a plurality of barbules extending outwardly from the shaft. It further has a base member formed having a tube shape adapted to connect with a hose member of a vacuum cleaner. The quill portions of the plurality of feathers are attached to the base member such that when in use, the barbules are adapted and used to agitate dust and dirt to be sucked through the base member and into the hose member of a vacuum cleaner.

The plurality of feathers, numbering about 25, are formed from a plastic material, and includes at least one perforation through the shaft adapted to allow dust and dirt to be sucked through, down the shaft, through the base member and into the hose member of a vacuum cleaner. The base member includes an adaptor ring adapted to frictionally fit between an inner wall thereof and an outer wall of an end portion of a vacuum hose. The base member is formed having a tapered shape such that an end portion connected with the quill portions of the plurality of feathers is larger than an opposite end portion adapted to be connected with the hose member of a vacuum cleaner.

A combination of a vacuum cleaner and an improved vacuum attachment comprising a vacuum cleaner including a hose member formed as an elongate tube, and an improved vacuum attachment comprising a plurality of feathers, each including an elongated hollow shaft having a quill portion at a proximal end, and a plurality of barbules extending outwardly from the shaft. It further has a base member formed having a tube shape adapted to connect with a hose member of a vacuum cleaner. The quill portions of the plurality of feathers are attached to the base member such that when in use, the barbules are adapted and used to agitate dust and dirt to be sucked through the base member and into the hose member of a vacuum cleaner.

The plurality of feathers, numbering about 25, are formed from a plastic material, and includes at least one perforation through the shaft adapted to allow dust and dirt to be sucked through, down the shaft, through the base member and into the hose member of a vacuum cleaner. The base member includes an adaptor ring adapted to frictionally fit between an inner wall thereof and an outer wall of an end portion of a vacuum hose. The base member is formed having a tapered shape such that an end portion connected with the quill portions of the plurality of feathers is larger than an opposite end portion adapted to be connected with the hose member of a vacuum cleaner.

The present invention holds significant improvements and serves as an improved vacuum attachment. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, improved vacuum attachment constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a vacuum attachment and more particularly to an attachment for a vacuum cleaner which combines a vacuum nozzle and a feather duster as used to improve the ability of consumers to gently and effectively dust and vacuum delicate, fragile objects without disturbing them.

Generally speaking, an improved vacuum attachment is a feathered vacuum attachment with feathers featuring perforated vacuum tubing for its shaft, from the bottom of the attachment to the top of the feather, which provides evenly channeled suction power and thus more-gentle when vacuuming the feather agitated dust particles on delicate items.

Figure 1:
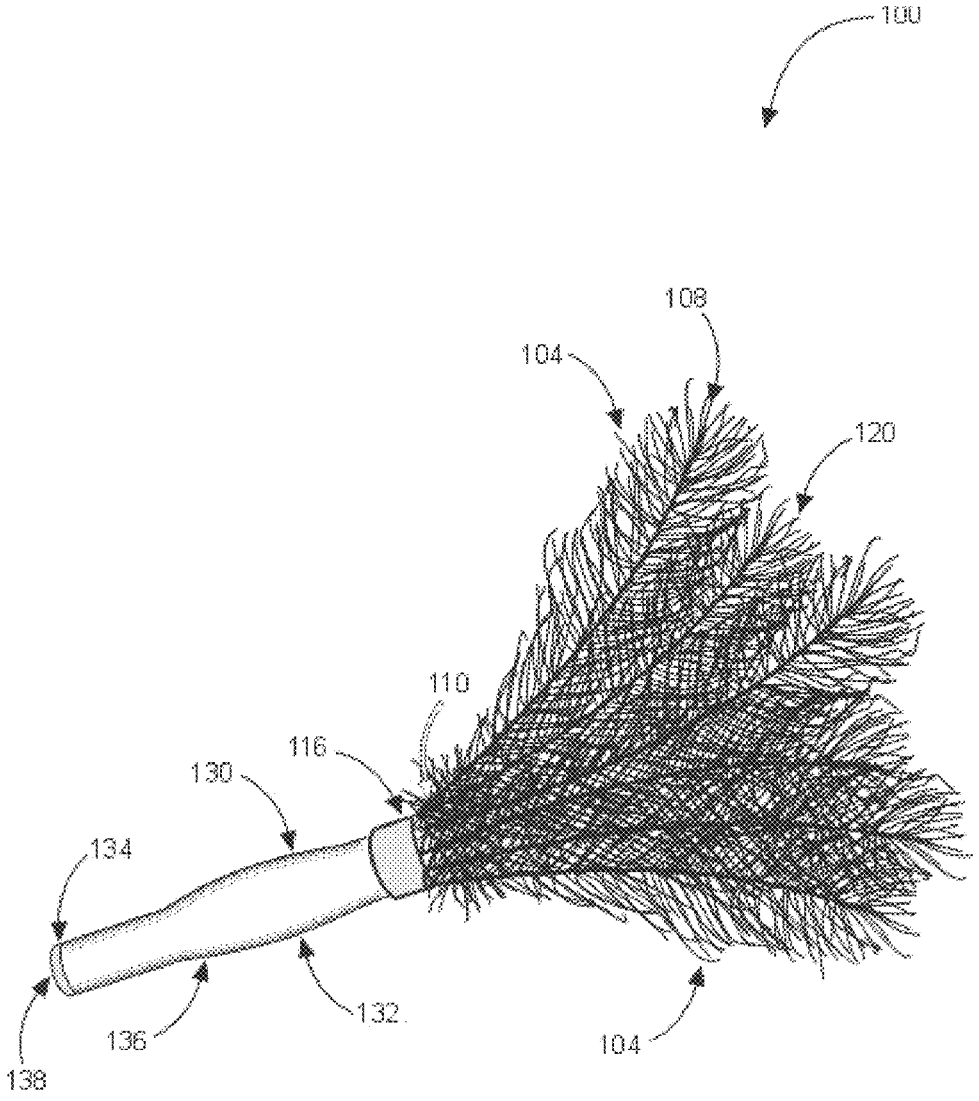
FIG. 1 shows a perspective view illustrating an improved vacuum attachment according to an embodiment of the present invention.

Referring to the drawings by numerals of reference there is shown in FIG. 1, a perspective view illustrating an improved vacuum attachment 100 according to an embodiment of the present invention.

Improved vacuum attachment 100 comprising plurality of feathers 104, each including elongated hollow shaft 106 having quill portion 110 at proximal end 112, and plurality of barbules 120 extending outwardly from elongated hollow shaft 106. It further has base member 130 formed having tube shape 132 adapted to connect with hose member 140 of vacuum cleaner 144. Quill portions 110 of plurality of feathers 104 are attached to base member 130 such that when in use, plurality of barbules 120 are adapted and used to agitate dust and dirt to be sucked through base member 130 and into hose member 140 of vacuum cleaner 144.

Figure 2:
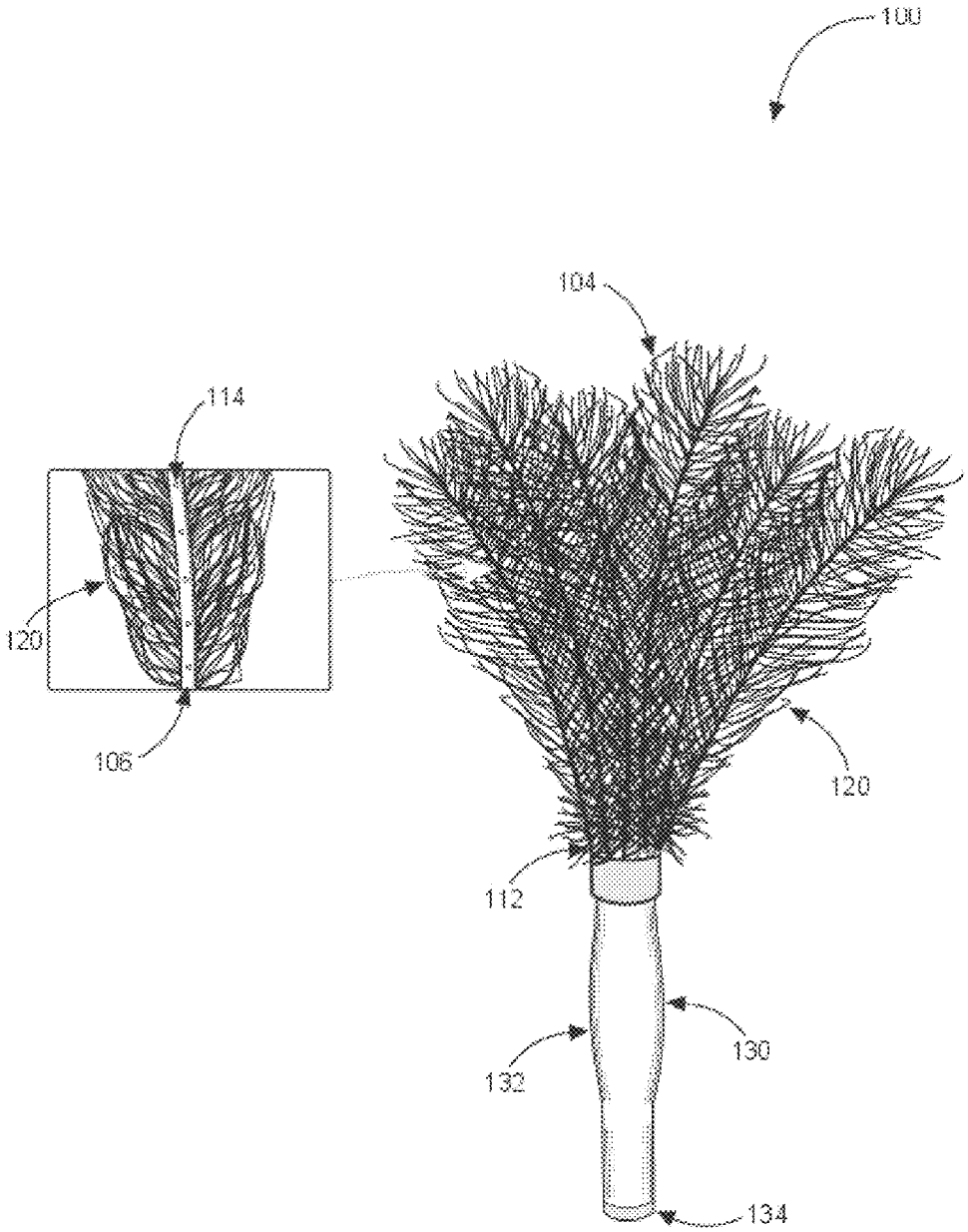
FIG. 2 is a perspective view illustrating an improved vacuum attachment with a close-up view of an elongated hollow shaft according to an embodiment of the present invention of FIG. 1.

Referring now to FIG. 2, a perspective view illustrating an improved vacuum attachment 100 with a close-up view of an elongated hollow shaft 106 according to an embodiment of the present invention.

Plurality of feathers 104, numbering about 25, are formed from plastic material 108, and includes at least one perforation 114 through elongated hollow shaft 106 adapted to allow dust and dirt to be sucked through, down elongated hollow shaft 106, through base member 130 and into hose member 140 of vacuum cleaner 144. Base member 130 includes adaptor ring 134 adapted to frictionally fit between inner wall 138 thereof and outer wall 146 of end portion 148 of hose member 140. Base member 130 is formed having tapered shape 136 such that shaft end portion 116 connected with quill portions 110 of plurality of feathers 104 is larger than an opposite end portion 148 adapted to be connected with hose member 140 of vacuum cleaner 144.

Figure 3:
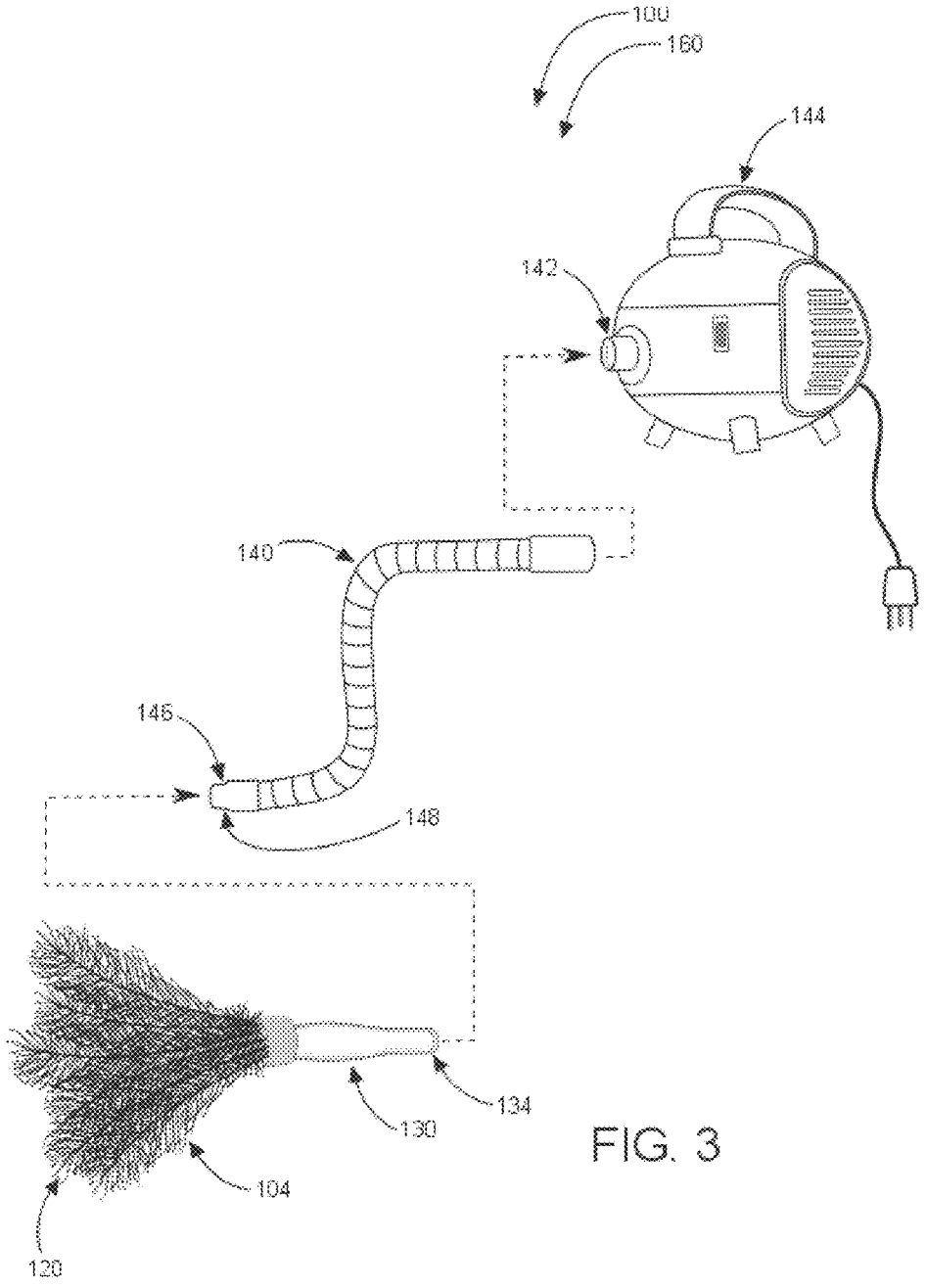
FIG. 3 is a perspective view illustrating a combination of an improved vacuum attachment and a vacuum cleaner with hose member according to an embodiment of the present invention of FIG. 1.

Referring now to FIG. 3, a perspective view illustrating a combination 160 of an improved vacuum attachment 100 and a vacuum cleaner 144 with hose member 140 according to an embodiment of the present invention.

Combination 160 of vacuum cleaner 144 and improved vacuum attachment 100 comprising vacuum cleaner 144 including hose member 140 formed as elongate tube 142, and improved vacuum attachment 100 comprising plurality of feathers 104, each including elongated hollow shaft 106 having quill portion 110 at proximal end 112, and plurality of barbules 120 extending outwardly from elongated hollow shaft 106. It further has base member 130 formed having tube shape 132 adapted to connect with hose member 140 of vacuum cleaner 144. Quill portions 110 of plurality of feathers 104 are attached to base member 130 such that when in use, plurality of barbules 120 are adapted and used to agitate dust and dirt to be sucked through base member 130 and into hose member 140 of vacuum cleaner 144.

Figure 4:
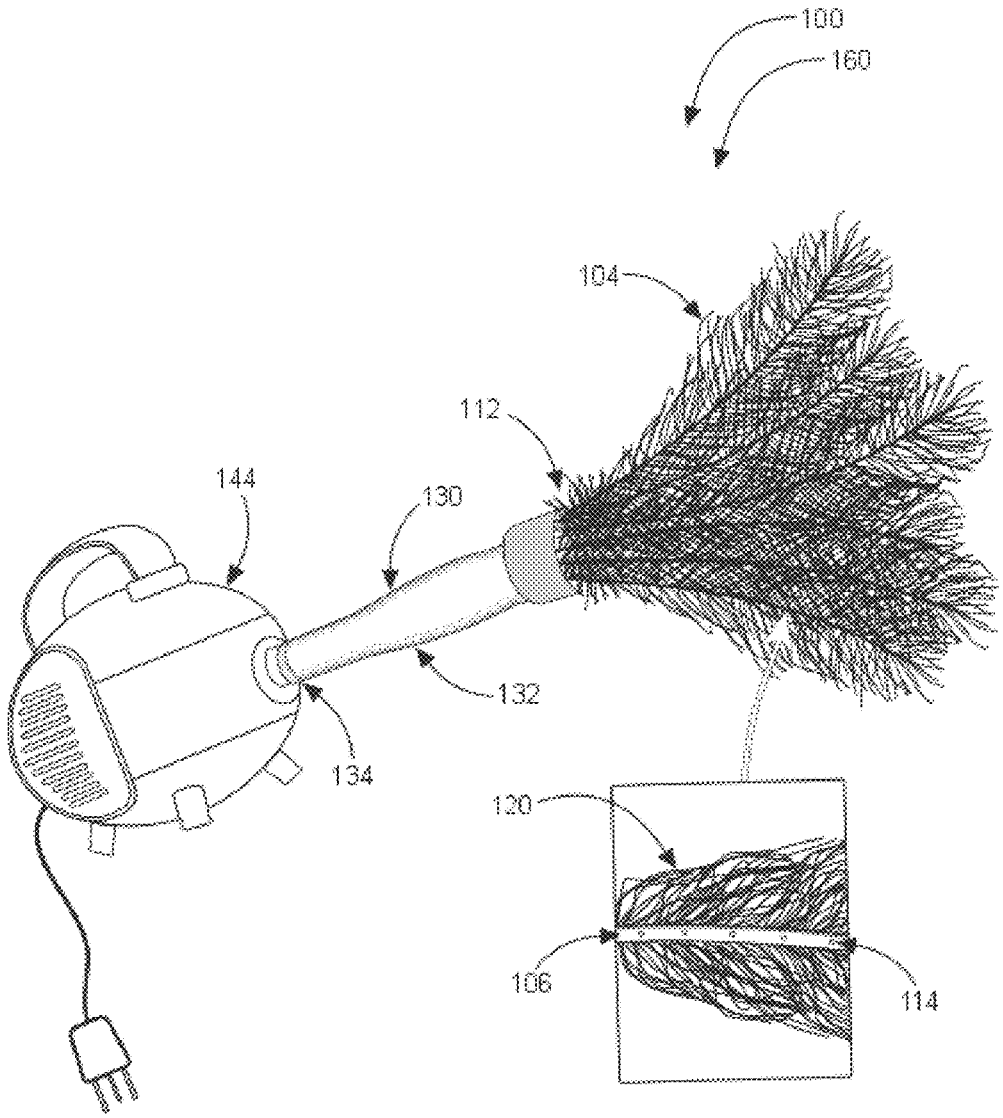
FIG. 4 is perspective view illustrating a combination of an improved vacuum attachment and a vacuum cleaner according to an embodiment of the present invention of FIG. 1.

Referring now to FIG. 4, a perspective view illustrating a combination 160 of an improved vacuum attachment 100 and a vacuum cleaner 144 according to an embodiment of the present invention.

Plurality of feathers 104, numbering about 25, are formed from plastic material 108, and includes at least one perforation 114 through elongated hollow shaft 106 adapted to allow dust and dirt to be sucked through, down elongated hollow shaft 106, through base member 130 and into hose member 140 of vacuum cleaner 144. Base member 130 includes adaptor ring 134 adapted to frictionally fit between inner wall 138 thereof and outer wall 146 of end portion 148 of hose member 140. Base member 130 is formed having tapered shape 136 such that shaft end portion 116 connected with quill portions 110 of plurality of feathers 104 is larger than an opposite end portion 148 adapted to be connected with hose member 140 of vacuum cleaner 144.

Improved vacuum attachment 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed:

1. An improved vacuum attachment comprising:
- a plurality of feathers each including:
  - an elongated hollow shaft having a quill portion at a proximal end thereof; and
  - a plurality of barbules extending outwardly from said shaft;
- a base member;
  - wherein said base member is formed having a tube shape adapted to connect with a hose member of a vacuum cleaner;
- wherein said quill portions of said plurality of feathers are attached to said base member such that when in use said barbules are adapted and used to agitate dust and dirt to be sucked through said base member and into said hose member of a vacuum cleaner;
- wherein each said plurality of feathers includes at least one perforation through said shaft adapted to allow dust and dirt to be sucked therethrough, down said shaft, through said base member and into said hose member of a vacuum cleaner.

2. The improved vacuum attachment of claim 1, wherein said plurality of feathers are formed from a plastic material.

3. The improved vacuum attachment of claim 1, wherein said plurality of feathers are formed from a synthetic material.

4. The improved vacuum attachment of claim 1, wherein there are 25 of said plurality of feathers.

5. The improved vacuum attachment of claim 1, wherein said base member includes an adaptor ring adapted to frictionally fit between an inner wall thereof and an outer wall of an end portion of said vacuum hose.

6. The improved vacuum attachment of claim 1, wherein said base member is formed having a tapered shape such that an end portion connected with said quill portions of said plurality of feathers is larger than an opposite end portion adapted to be connected with said hose member of said vacuum cleaner.

7. A combination of a vacuum cleaner and an improved vacuum attachment comprising:
- a vacuum cleaner including:
  - a hose member formed as an elongate tube; and
- an improved vacuum attachment comprising:
  - a plurality of feathers each including:
    - an elongated hollow shaft having a quill portion at a proximal end thereof; and
    - a plurality of barbules extending outwardly from said shaft;
  - a base member;
    - wherein said base member is formed having a tube shape adapted to releasably connect with said hose member of said vacuum cleaner;
- wherein said quill portions of said plurality of feathers are attached to said base member such that when in use said barbules are adapted and used to agitate dust and dirt to be sucked through said base member and into said hose member of said vacuum cleaner;
- wherein each said plurality of feathers includes at least one perforation through said shaft adapted to allow dust and dirt to be sucked therethrough, down said shaft, through said base member and into said hose member of a vacuum cleaner.

8. The improved vacuum attachment of claim 7, wherein said plurality of feathers are formed from a plastic material.

9. The improved vacuum attachment of claim 7, wherein said plurality of feathers are formed from a synthetic material.

10. The improved vacuum attachment of claim 7, wherein there are 25 of said plurality of feathers.

11. The improved vacuum attachment of claim 7, wherein said base member includes an adaptor ring adapted to frictionally fit between an inner wall thereof and an outer wall of an end portion of said vacuum hose.

12. The improved vacuum attachment of claim 7, wherein said base member is formed having a tapered shape such that an end portion connected with said quill portions of said plurality of feathers is larger than an opposite end portion adapted to be connected with said hose member of said vacuum cleaner.

* * * * *